United States Patent [19]

Swanson et al.

[11] 4,274,087

[45] Jun. 16, 1981

[54] ANNUNCIATOR MONITOR CIRCUIT

[76] Inventors: Dan E. Swanson, 1340 Paradise Dr., Martinez; Frederick A. Reschert, 2734 Kevin Rd., San Pablo, both of Calif.

[21] Appl. No.: 68,836

[22] Filed: Aug. 22, 1979

[51] Int. Cl.[3] ..... G08B 25/00

[52] U.S. Cl. ..... 340/525; 340/510; 340/514; 340/541

[58] Field of Search ..... 340/500, 506, 509, 510, 340/514, 517, 521, 524, 525, 533, 537, 541, 544

[56] References Cited

U.S. PATENT DOCUMENTS

| | | | |
|---|---|---|---|
| 3,716,834 | 2/1973 | Adams | 340/524 |
| 4,118,700 | 10/1978 | Lenihan | 340/537 |

*Primary Examiner*—Alvin H. Waring

*Attorney, Agent, or Firm*—Townsend and Townsend

[57] ABSTRACT

A system for displaying the location of an open switch in a series alarm protection circuit containing a plurality of switches. A plurality of independent input monitoring circuits includes a display array to visually indicate the input status of each circuit, the monitoring circuits and visual displays being mounted on a common plate. The high input resistance of the monitoring circuits allows direct connection in a pre-determined sequence to the alarm protection circuit. An unconnected normally closed alarm protection loop has a higher and lower positive voltage value with respect to common voltage of the alarm unit at its input terminals. Designating the higher value as "start" and the lower value as "finish", the monitoring circuits are connected through a sequential order to the finish side of each serially connected switch. As a switch is opened all monitoring circuits that are electrically connected through a closed switch to the start terminals will display a lighted condition. Those monitoring circuits that are connected on the down-stream or "finish" side of an open switch will display an extinguished condition. Due to the sequential connections, the first extinguished display is the location of the fault.

10 Claims, 5 Drawing Figures

VCC
6 VDC
12 VDC
(+)
(-)
13
58
59
60
61
12
44
45
46
63
64
65
67
69
21
22
23
24
25
26
27
28
29
30
31
32

ANNUNCIATOR MONITOR CIRCUIT

BACKGROUND OF THE INVENTION

This invention relates to annunciator monitor circuits of the type used to identify malfunctioning status switches in a protection loop.

Annunciator monitor circuits are known which are used in conjunction with protection loop devices having a plurality of serially connected, normally closed status switches to monitor a physical condition. For example, when used in a burglar alarm environment, each status switch is typically physically connected to a point of entry into a building or room and the switches are coupled in a series loop connected to a source of electrical power and an alarm unit, such as a bell, an emergency telephone number dialing device, or the like. When the structure is compromised by an intruder, the status switch associated to the particular point of entry opens, thereby opening the series loop and causing the alarm to be triggered.

In alarm control units of the above type, status switch contact monitoring devices have been employed in the past in order to provide an indication of the integrity of the protection loop including the status switches. In some early systems, a single test lamp is merely inserted in series with the status switches, and the integrity of the entire loop including the status switches is indicated by illumination of the test lamp when the annunciator is activated by the application of electrical power. More recently developed monitoring systems have employed individual test lamps, such as light emitting diodes, positioned at each of the status switch locations to enable a visual check of the integrity of each individual status switch at its particular location. Still other contact monitoring systems have employed a digital read out device having a plurality of priority encoded input terminals each coupled to a different one of the status switches for providing a numerical indication of the integrity of each status switch. Each of the above types of status switch monitoring circuits suffers from the disadvantage of incompatibility with present day solid state alarm control units, which are designed to provide high sensitivity to changing input status signals and relatively low power consumption when activated. More particularly, the sensitivity of modern solid state alarm control circuits is so high that the insertion across the status switches of a contact monitoring device capable of drawing even a few milliamperes of current from the protection loop will compromise or defeat the alarm unit by providing a current path around the switch through its own internal resistance.

A further drawback to the single test lamp type of contact monitoring system, and also the multiple test lamp, switch location mounted type of contact monitoring system, is the difficulty in quickly verifying the integrity of the system and isolating a fault location. More particularly, in the former, single test lamp type, each status switch must be individually tested to determine the source of a fault; while in the latter type of system each point of entry of the protective structure must be visually inspected. Since a large percentage of service calls made by service technicians in the alarm trade usually results in the location of a single malfunctioning switch, or a door or window inadvertently left open, annunciator systems having status switch monitoring circuits of these two types are costly to maintain.

SUMMARY OF THE INVENTION

The invention comprises a status switch monitoring unit for use as an annunciator system which is relatively inexpensive to fabricate, fully compatible with both modern alarm control units, and earlier, less sensitive alarm control units, can be conveniently installed at a central location, and which provides an instant indication of the integrity of a protection loop or an instant indication of the identity of a malfunctioning status switch by the actuation of a test switch.

The invention includes a power input terminal means adapted to be coupled to a source of electrical power; a plurality of status signal input terminals adapted to be coupled in a preferred order between the status switches, each of the status signal input terminals being adapted to be coupled between a different one of the plurality of status switches; a plurality of input resistor divider networks each coupled between a different one of the status signal input terminals and electrical ground for providing a minimum operating voltage threshold signal at an output terminal thereof, each resistor divider network having a relatively high input resistance; a plurality of high sensitivity, low power gating circuits each having an input terminal coupled to the output terminal of a different one of the plurality of input resistor divider networks; a plurality of light emitting diode indicators each having a cathode terminal coupled to a different one of the plurality of gating circuits and an anode terminal coupled to a common junction; and a test switch coupled between the common junction and the power input terminal means for enabling the anode terminal of each of the light emitting diode indicators to be coupled to the electrical power source so that the presence of a status signal of sufficient magnitude at the corresponding status signal input terminal causes the associated light emitting diode indicator to be illuminated whenever the test switch is actuated.

The input resistor divider networks have a relatively high resistance which provides an inter-terminal resistance of at least 6 megohms in the preferred embodiment, each input resistor divider network comprising a pair of resitors having a preferred ratio of substantially 1:2. In order to suppress transient signals, each of the input resistor divider networks preferably includes an RF bypass capacitor coupled to ground.

Each of the gating circuits preferably comprises a CMOS inverter driver circuit, a plurality of the gating circuits being located in two single IC packages.

A voltage dropping resitors is connected in series with the common junction and the test switch, and two individual power voltage leads are connected across the voltage dropping resistor to enable operation of the monitor over a dual range of voltages and thus render the invention compatible with a wide variety of types of alarm control units.

All components are enclosed in a single housing, with the light emitting diode indicators arranged in an ordered array on the face plate of the housing, and the test switch, which preferably comprises a manually operable momentary contact switch, mounted on the face plate. A plurality of flexible insulated conductors, each coupled to a different one of the status signal input terminals extend from the housing to facilitate connection of the monitor to the protection loop status switches.

In the preferred installation, the protection loop status switches comprise an ordered sequence of normally closed switches having a first switch coupled to a higher voltage terminal for the loop and a last switch coupled to a lower voltage terminal for the loop, and the status signal input terminals are connected to the status switches in sequentially ascending order so that the plurality of light emitting diode indicators provide an ordered set of status indicators for enabling visual identification of a malfunctioning status switch.

Due to the relatively high input resistance and the relatively low current drain from the protection loop when the invention is installed, the device may be used with both modern alarm control units having relatively high sensitivity and also less sensitive earlier types of alarm control units without compromising the protection loop status switches. In addition, the low current drain of the invention permits the use of relatively long conductive leads, if required, for installation of the device with the associated alarm control unit without impairing the reliability of the system.

For a fuller understanding of the nature and advantages of the invention, reference should be made to the ensuing detailed description taken in conjunction with the accompanying drawings.

DESCRIPTION OF THE PREFERRED EMBODIMENT

Figure 1A:
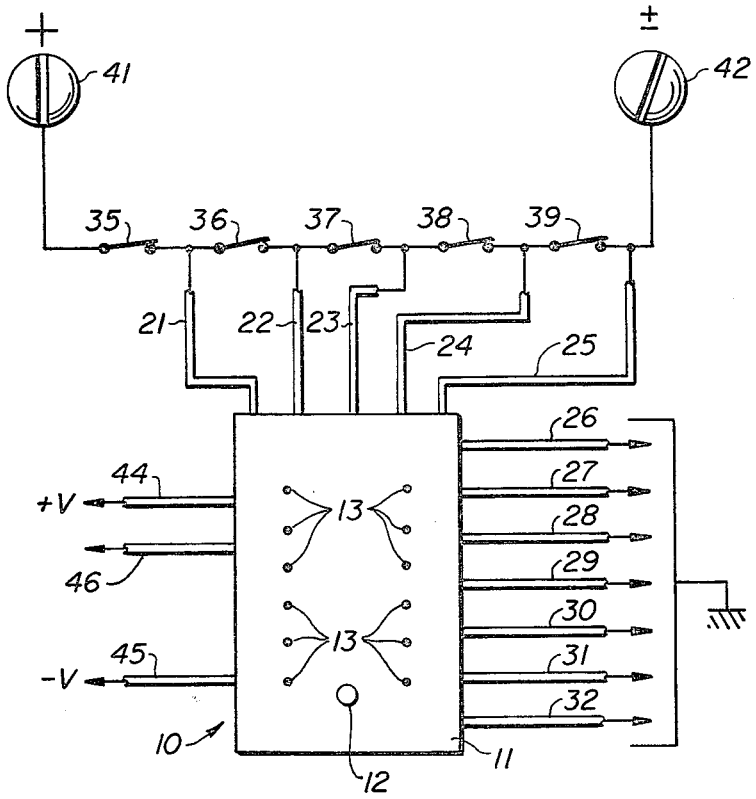
FIG. 1*a* is a simplified schematic diagram of the invention installed in a single loop annunciator unit.

Turning now to the drawings, FIG. 1*a* illustrates a preferred embodiment ofhe invention installed in a single loop type of annunciator unit. As seen in this figure, the invention includes a housing generally designated by reference numeral 10 and including a face plate 11 on which a momentary contact pushbutton switch 12 is mounted. A plurality of light emitting diodes 13 are mounted in housing 10 in such a manner as to be viewable from the face plate 11. Extending from the housing 10 (see also FIG. 1*c*) are a first plurality of flexible insulated conductive leads 21–25, and a second plurality of such leads 26 –32.

The first plurality of leads 21–25 are individually connected between a serially connected array of status switches 35–39 forming a portion of a protection loop in a single loop type annunciator system. The first switch 35 in the series is coupled to the START terminal 41 of the associated alarm control unit, while the last switch 39 is coupled to the FINISH terminal 42 of the alarm control unit. As will be appreciated by those skilled in the art, the START terminal 41 provides a higher DC voltage, while the FINISH terminal 42 provides a lower DC voltage for the loop.

The second plurality of flexible conductive leads 26–32 are coupled to electrical ground in the FIG. 1*a* installation, and are thus unused.

A pair of terminals 44, 45 extending from the left of housing 10 as viewed in FIG. 1*a* are coupled respectively to the positive and negative terminals of a suitable voltage source for operating the light emitting diodes 13 in the manner described below.

Also extending to the left of housing 10 in FIG. 1*a* is another electrically conductive, insulated lead 46 for enabling operation of the invention with a lower range voltage in the manner described below.

Once installed, the invention is operated by merely actuating momentary contact switch 12. When the associated alarm control unit is activated, current will normally flow from terminal 41 to terminal 42 through the switches 35–39 when the switches are in their normally closed positions. Malfunctioning of any one of switches 35–39, or the opening of the point of entry protected by each of switches 35–39 (e.g., doors, windows and the like) will cause each of the light emitting diodes 13 electrically downstream from the malfunctioning switch to remain extinguished when test switch 12 is momentarily actuated. Once the faulty switch is so isolated, it may be inspected and repaired or replaced. As will be apparent, the housing 10 is preferably mounted in a central location, preferably adjacent the central station for the associated alarm control unit.

Figure 1B:
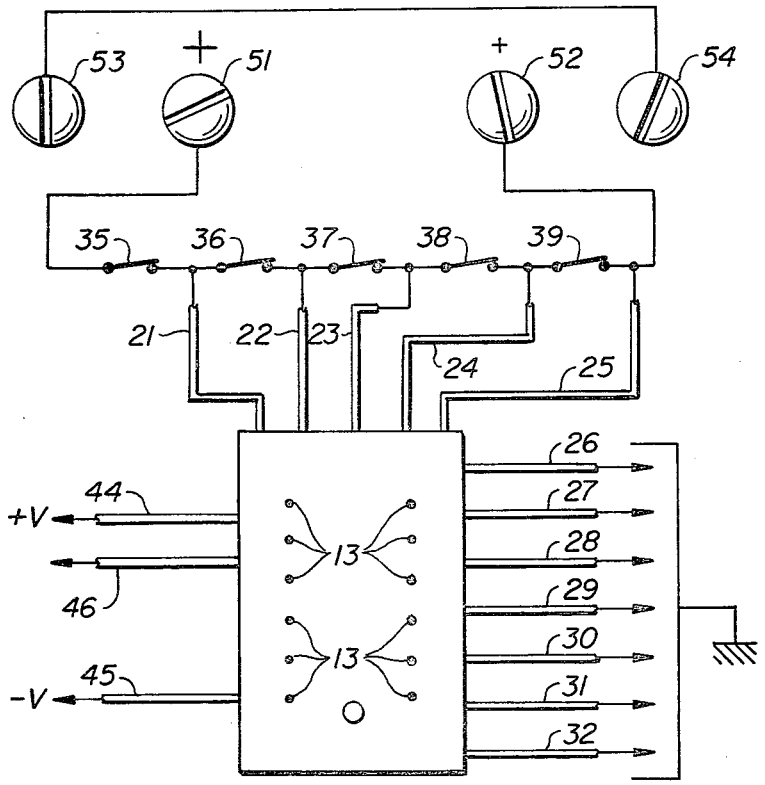
FIG. 1*b* is a simplified schematic diagram of the invention installed in a dual loop type annunciator unit.
Figure 1C:
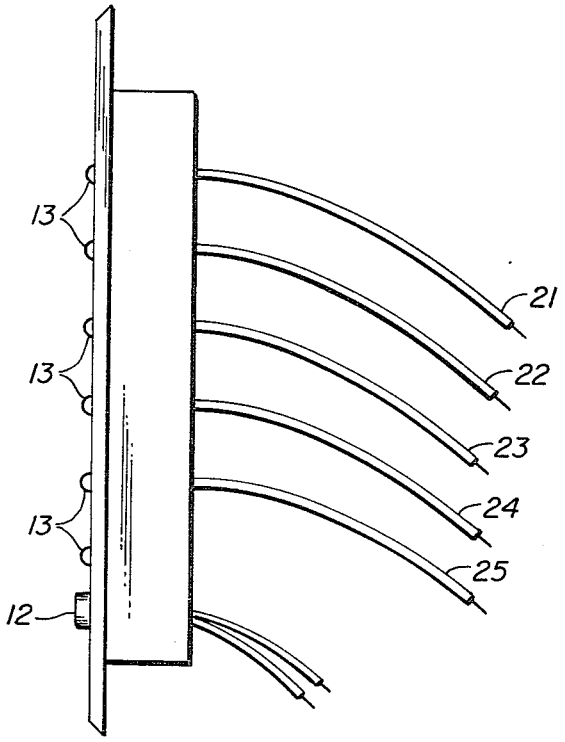
FIG. 1*c* is a side view of the preferred embodiment of the invention.

FIG. 1*b* illustrates the manner in which the invention is connected to a dual loop type of annunciator monitor unit. As seen in this figure, the switches 35–39 are coupled between the higher voltage terminal 51 and the lower voltage terminal 52 of the "slow" loop, rather than to the terminals 53, 54 of the conventional "fast" or negative loop. The remaining connections, as well as the operation of the invention, are identical to that of FIG. 1*a*.

Figures 2, 3:
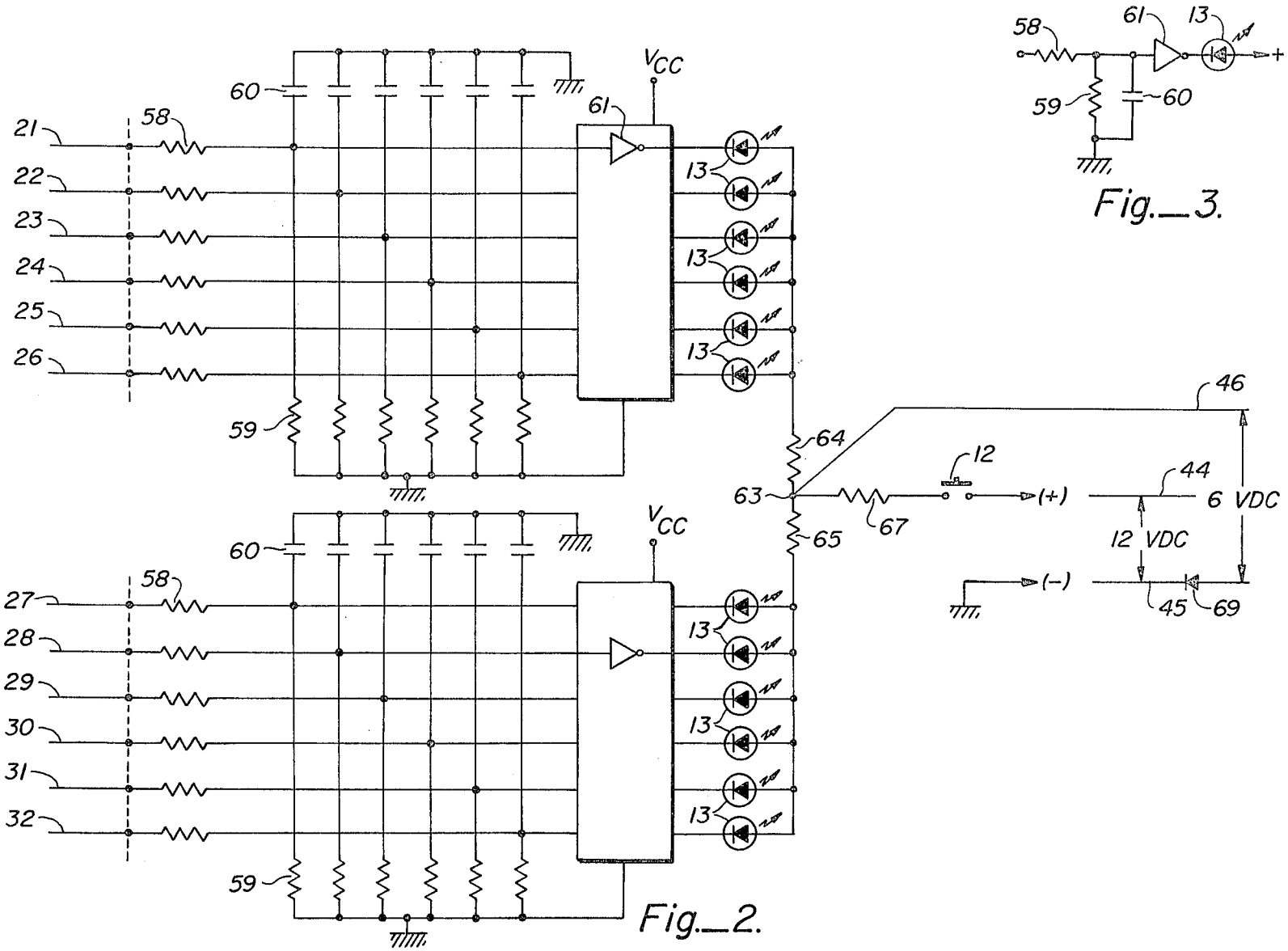
FIG. 2 is a circuit diagram of the preferred embodiment of the invention.
FIG. 3 is an equivalent circuit diagram of a single branch of the FIG. 2 circuit.

With reference to FIG. 2, the preferred embodiment includes a plurality of identical voltage divider networks, each consisting of a pair of resistors 58, 59 coupled between an associated one of the input terminal conductors (e.g., conductor 21) and ground. Each voltage divider network includes a bypass capacitor 60 coupled between the common junction of resistors 58, 59 and ground in order to suppress transient and RF signals to prevent false triggering of the circuit.

A plurality of CMOS type combination inverter/-driver gates 61, corresponding in number to the input terminal leads 21–32 and resistor divider networks, are provided, each gate 61 being coupled between the junction of associated network resistors 58, 59 and the cathode of an associated light emitting diode indicator 13. Gates 61 are commercially available devices, such as a type 4049 CMOS hex inverter driver integrated circuit package. As will be apparent to those skilled in the art, gates 61 afford high sensitivity with extremely low power consumption from input power signals.

Each of the light emitting diode indicators 13 is coupled to a common junction 63 via voltage dropping resistors 64, 65. Junction 63 is coupled via an additional voltage dropping resistor 67 to one terminal of test switch 12, the remaining terminal of which is coupled to the positive operating voltage input terminal 44. Element 46 comprises another conductive lead which is used to bypass voltage dropping resistor 67 when the invention is coupled to a source of relatively low voltage (approximately 6 volts DC). To operate the invention with a relatively higher voltage (e.g., 12 volts DC) lead 44 is coupled to the positive terminal of a suitable DC source and voltage dropping resistor 67 is included in the power input circuitry. To operate the invention with a relatively lower voltage, lead 44 is disconnected and lead 46 is coupled to the positive voltage terminal of the DC source. A protective diode 69 is provided in the negative terminal 45 path to protect the circuit components against the application of DC power of the wrong polarity should the unit be connected improperly to the DC power source.

FIG. 3 illustrates in circuit diagram form a single branch of the preferred embodiment of the invention. As seen in this figure, the voltage dropping network comprising resistors 58, 59 and capacitor 60 provide an operating threshold of predetermined magnitude (approximately 3.8 VDC) for gate 61, and thus associated light emitting diode 13. Capacitor 60 provides an AC shunt circuit for RF and transient voltages present at the input to gate 61. In operation, with a status input signal of magnitude at least equal to the operating threshold voltage, the output of gate 61 will be low and LED 13 will be illuminated whenever a voltage is present at the anode input thereto (by momentary actuation of test switch 12 (FIG. 2)). Whenever the input voltage to gate 61 lies below the predetermined operating threshold, the cathode of LED 13 is held high and the LED is extinguished.

For proper operation of the circuit of FIG. 2, the input resistance as seen by any of the input terminals 21–32 should be relatively high in order to prevent excess current drain from the protection loop of the associated alarm control unit. Best results have been obtained using values of 1.0 megohm for resistors 58, 2.2 megohms for resistor 59 and 0.05 microfarads for capacitor 60. Generally, an input resistance ratio between resistor 58 and resistor 59 of approximately 1:2 is acceptable. In the preferred embodiment, an inter-terminal resistance in excess of 6 megohms (e.g., between terminals 21, 22, etc.) provides sufficient protection against faulty alarm indications from the associated alarm control unit. With 6 volt operation, the preferred embodiment exhibits a total current consumption of 20 milliamperes with one LED 13 illuminated and 40 milliamperes with twelve LEDs 13 illuminated, and an input current drain from the associated protection loop of from 2 nanoamperes (one LED illuminated) to 20 nanoamperes (twelve LEDs illuminated). For 12 volt operation, the total current draw is from 40 to 80 milliamperes and the total input current drain from the protection loop ranges from 4 to 40 nanoamperes.

While the above provides a completed description of the preferred embodiment of the invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. An annunciator monitor for use with a protection loop having a plurality of series connected status switches, said annunciator monitor comprising:

power input terminal means adapted to be coupled to a source of electrical power;

a plurality of status signal input terminals adapted to be coupled in a preferred order between said status switches, each of said status signal input terminals being adapted to be coupled between a different pair of said plurality of status switches;

a plurality of input resistor divider networks each coupled between a different one of said status signal input terminals and ground for providing a minimum operating voltage threshold signal at an output terminal thereof, each said resistor divider network having a relatively high input resistance;

a plurality of high sensitivity low power gating circuits each having an input terminal coupled to the output terminal of a different one of said plurality of input resistance divider networks;

a plurality of light emitting diode indicators each having a cathode terminal coupled to a different one of said plurality of gating circuits and an anode terminal coupled to a common junction; and power application means coupled between said common junction and said power input terminal means for enabling the anode terminal of each of said light emitting diode indicators to be coupled to said electrical power source so that the presence of a status signal of sufficient magnitude at the corresponding status signal input terminal causes the associated light emitting diode indicator to be illuminated.

2. The apparatus of claim 1 wherein said plurality of input resistor divider networks have an inter-terminal resistance of at least 6 megohms.

3. The apparatus of claim 1 wherein each of said input resistor divider networks comprises a pair of resistors having a ratio of substantially 1:2.

4. The apparatus of claim 1 wherein each of said input resistor divider networks includes an RF bypass capacitor coupled to ground to suppress transient signals and prevent false illumination of the associated light emitting diode indicator.

5. The apparatus of claim 1 wherein each of said gating circuits comprises a CMOS inverter driver circuit.

6. The apparatus of claim 1 further including voltage dropping resistor means connected in series with said common junction and said power application means, and an additional power input terminal means coupled to said common junction for bypassing said voltage dropping resistor means to enable operation of said annunciator over a dual range of voltages.

7. The apparatus of claim 1 wherein said power application means comprises a manually operable momentary contact switch.

8. The apparatus of claim 1 further including a housing having opposing side edges, a top edge and a bottom edge, and a face plate; and wherein said light emitting diode indicators are mounted for viewing from said face plate and said power application means is mounted on said face plate, said housing enclosing the remaining elements of claim 1.

9. The apparatus of claim 8 further including a plurality of flexible insulated conductors each coupled to a different one of said status signal input terminals and extending from said housing to facilitate connection of said annunciator monitor to said status switches.

10. The apparatus of claim 1 wherein said status switches comprise an ordered sequence of normally closed switches having a first switch coupled to a higher voltage terminal for said loop and a last switch coupled to a lower voltage terminal for said loop, and wherein said status signal input terminals are connected to said status switches in sequentially ascending order so that said plurality of light emitting diode indicators provide an ordered set of status indicators for enabling visual identification of a malfunctioning one of said status switches.

* * * * *

UNITED STATES PATENT AND TRADEMARK OFFICE

CERTIFICATE OF CORRECTION

PATENT NO. : 4,274,087

DATED : June 16, 1981

INVENTOR(S) : Dan E. Swanson

It is certified that error appears in the above-identified patent and that said Letters Patent are hereby corrected as shown below:

Column 3, line 41, change "ofhe" to --of the--.

Signed and Sealed this

*Second* Day of *February 1982*

[SEAL]

*Attest:*

GERALD J. MOSSINGHOFF

*Attesting Officer*

*Commissioner of Patents and Trademarks*